US005211329A

United States Patent [19]

Patton

[11] Patent Number: 5,211,329

[45] Date of Patent: May 18, 1993

[54] FOOD PRODUCT CONTAINER

[75] Inventor: James D. Patton, Arlington, Tex.

[73] Assignee: Bates Container, Inc., N. Richland Hills, Tex.

[21] Appl. No.: 904,374

[22] Filed: Jun. 25, 1992

[51] Int. Cl.[5] ..... B65D 5/22

[52] U.S. Cl. ..... 229/110; 229/125; 229/150; 229/151; 229/178; 229/906

[58] Field of Search ..... 229/110, 125, 149, 150, 229/151, 152, 178, 186, 902, 903, 906

[56] References Cited

U.S. PATENT DOCUMENTS

| | | | |
|---|---|---|---|
| 880,410 | 2/1908 | Singer | 229/125 |
| 1,411,678 | 4/1922 | Walker | 229/178 |
| 2,751,138 | 6/1956 | Laver | 229/178 |
| 2,774,529 | 12/1956 | Abrams et al. | 229/125 |
| 3,300,116 | 1/1967 | Grashege | 229/150 |
| 4,919,326 | 4/1990 | Deiger | 229/906 |
| 5,000,374 | 3/1991 | Deiger | 229/906 |
| 5,110,039 | 5/1992 | Phillips | 229/906 |
| 5,118,032 | 6/1992 | Geho | 229/110 |

FOREIGN PATENT DOCUMENTS

| | | | |
|---|---|---|---|
| 6612684 | 8/1967 | Netherlands | 229/178 |
| 751638 | 7/1956 | United Kingdom | 229/125.28 |

*Primary Examiner*—Gary E. Elkins
*Attorney, Agent, or Firm*—James E. Bradley

[57] ABSTRACT

A container for a food product, such as pizza, has a bottom, two side walls, a rear wall and a front wall, all formed from a single blank of paperboard. A lid folds over the rear wall. Lid flaps depend from the lid on each side for insertion on an interior side of each of the side walls. The lid flaps have a retaining portion of greater height and a recessed portion. Diagonal corner walls extend between the side walls and the front wall. A slot locates in each corner wall for receiving a tab depending from the lid to lock the lid in a closed position. The slot and tabs have lower edge that incline in opposite directions.

9 Claims, 3 Drawing Sheets

FOOD PRODUCT CONTAINER

BACKGROUND OF THE INVENTION

1. Field of the invention

This invention relates in general to paperboard containers for food products, such as pizza.

2. Description of the Prior Art

A large industry has grown in the delivery of pizzas. The pizza will be inserted into a container and delivered to homes, offices and the like. The containers are normally of a paperboard, such as corrugated paper. The container will be fabricated from a single blank of corrugated paper. The restaurant will erect the blank into the shape of a container for holding the pizza.

Prior art containers utilize a variety of fold lines, interlocking tabs and the like. Many of the containers are rectangular. This results in some waste of material because most pizzas are circular. One container, shown in U.S. Pat. No. 4,765,534, Aug. 23, 1988, Kenneth J. Zion, et al., is octagonal in configuration.

While these containers work well enough, improvements are desirable. For example, reducing the amount of material, and making the box easier and faster to erect are desirable goals.

SUMMARY OF THE INVENTION

The container in this invention erects into a receptacle with a lid before the pizza is inserted. The container has a bottom, side walls, rear wall and a front wall. A lid extends from the rear wall and folds over to a closed position. Lid flaps extend downward from opposite side edges of the lid. The flaps will insert into the interior of the sidewalls for frictionally retaining the lid in a half open position during insertion of the pizza.

The lid flaps have a rearward retaining portion and a forward recessed portion. The retaining portion has a greater height than the recessed portion. When in a closed position, the retaining portion will extend into contact with the bottom of the container. The recessed portion, however, is spaced above, defining a clearance for a portion of the perimeter of the pizza to locate within. This allows the edge of the pizza to extend completely to the sidewalls.

Also, the container has diagonal corner walls intersecting the sidewalls with the front wall. The corner walls fold over, resulting in an inner ply and an outer ply. Joining flaps on the front wall and on the sidewalls sandwich between the inner and outer plys to hold the container in a receptacle configuration. A slot locates on the outer ply. A tab extends from the forward edge of the lid for reception in the slot to lock the lid in a closed position. For easier insertion, the lower edges of the slots and the lower edges of the tabs inclined in opposite directions.

DETAILED DESCRIPTION OF THE INVENTION

Figure 1:
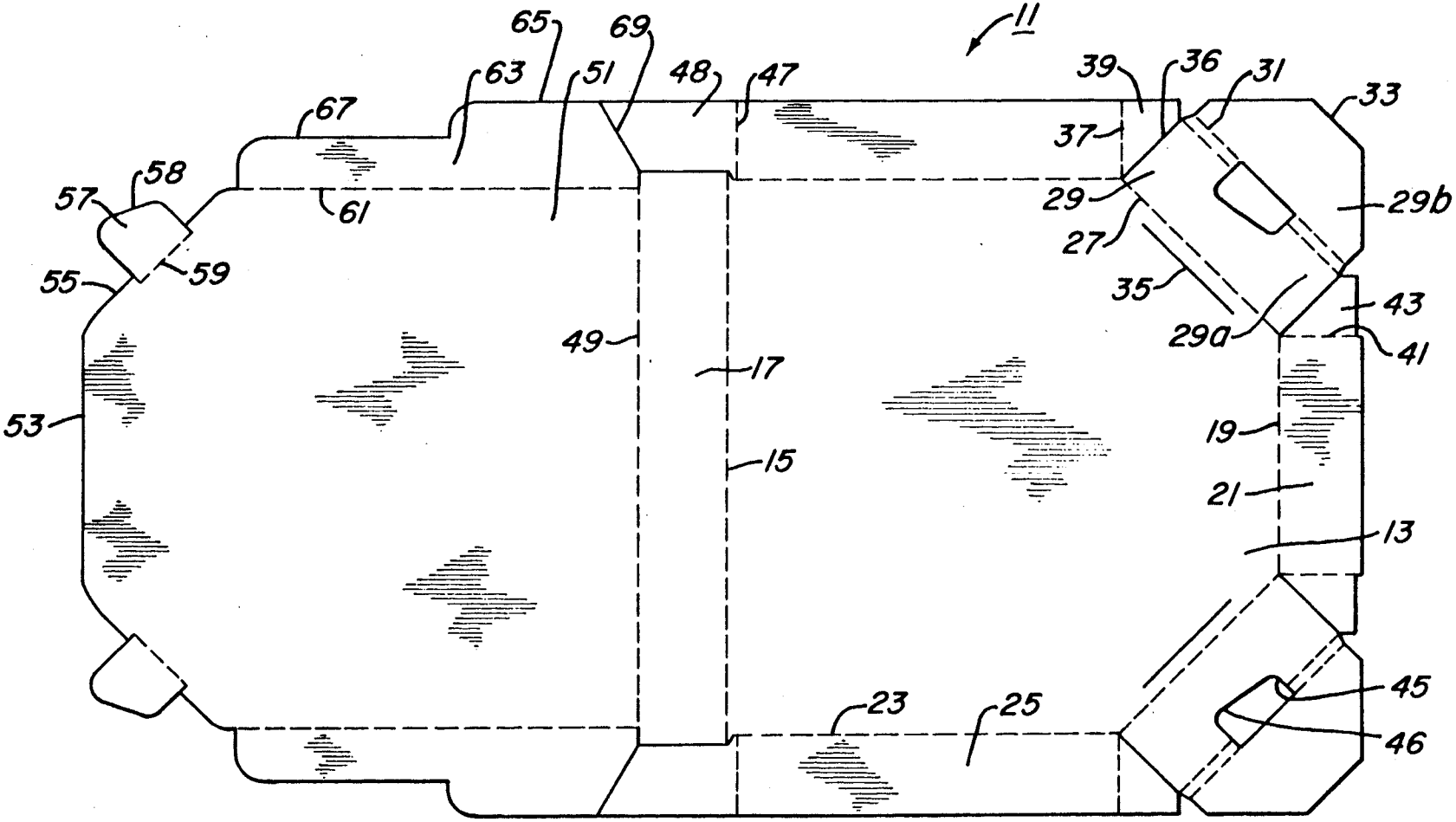
FIG. 1 is a plan view illustrating a blank of paperboard having fold lines for construction into a container in accordance with this invention.

Referring to FIG. 1, container 11 is made from a single piece of paperboard, normally corrugated paper. Container 11 has a bottom 13, which has a rear fold line 15 on its rear edge. Rear fold line 15 defines a rear wall 17 that will fold about rear fold line 15 to a position perpendicular to bottom 13. A front fold line 19, parallel to rear fold line 15, locates on an opposite edge of bottom 13. Front fold line 19 defines a front wall 21. Front wall 21 will fold to a position perpendicular to bottom 13.

A pair of side fold lines 23 are located on opposite sides of bottom 13, each side fold line 23 being perpendicular to the rear fold line 15 and front fold line 19. Side fold lines 23 define two opposite side walls 25. Side walls 25 fold about side fold lines 23 to a position perpendicular to bottom 13.

A pair of corner fold lines 27 join each side fold line 23 with the front fold line 19. Each corner fold line 27 is diagonal, being at a 45 degree angle to the front fold line 19 and side fold lines 23. The corner fold lines 27 define two corner walls 29. Corner walls 29 will fold to a position perpendicular to bottom 13 and at a 45 degree angle relative to the front wall 21 and side walls 25.

Figure 2:
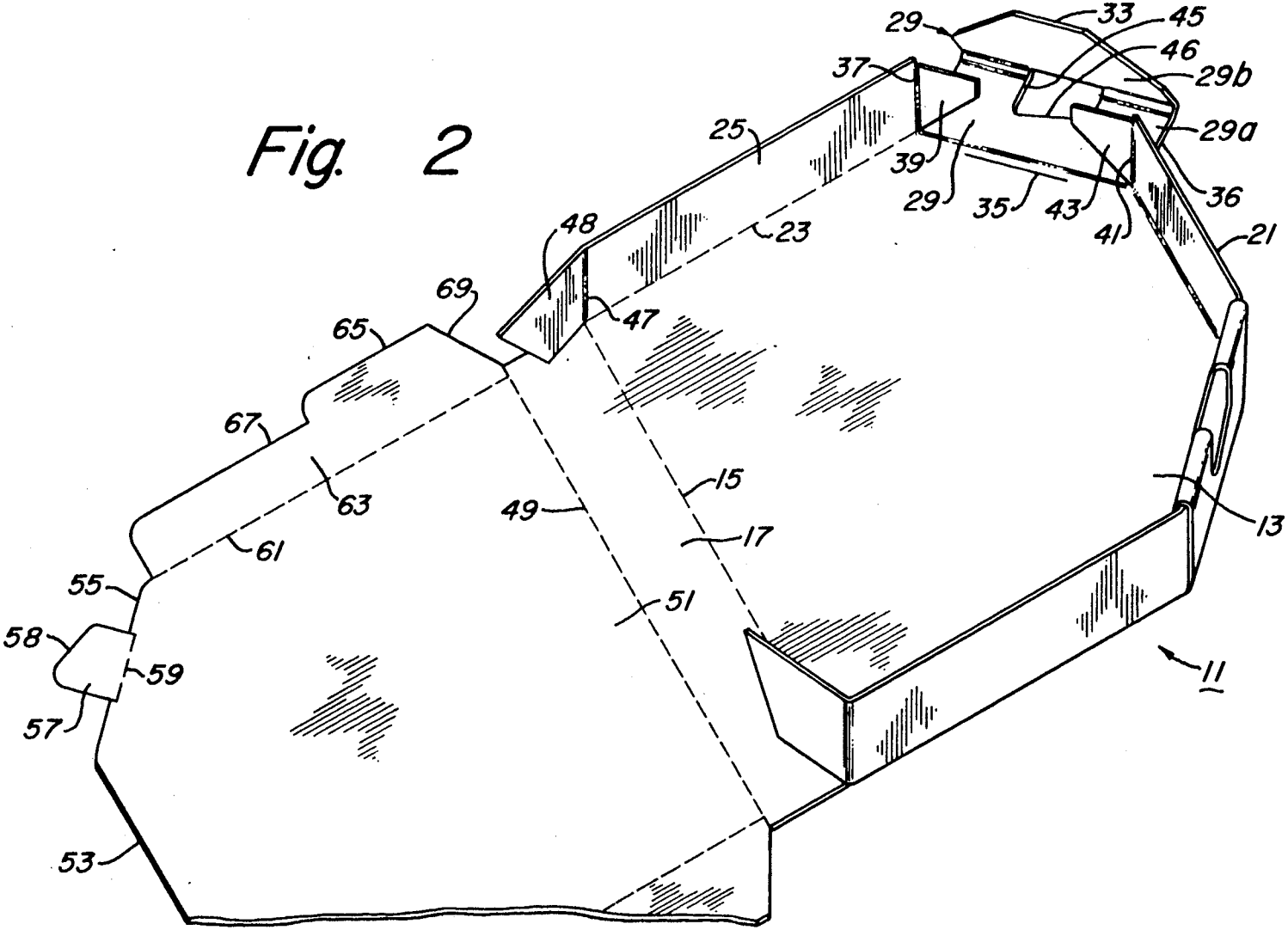
FIG. 2 is a perspective view of a portion of the container of FIG. 1 showing part of the erection process.
Figure 3:
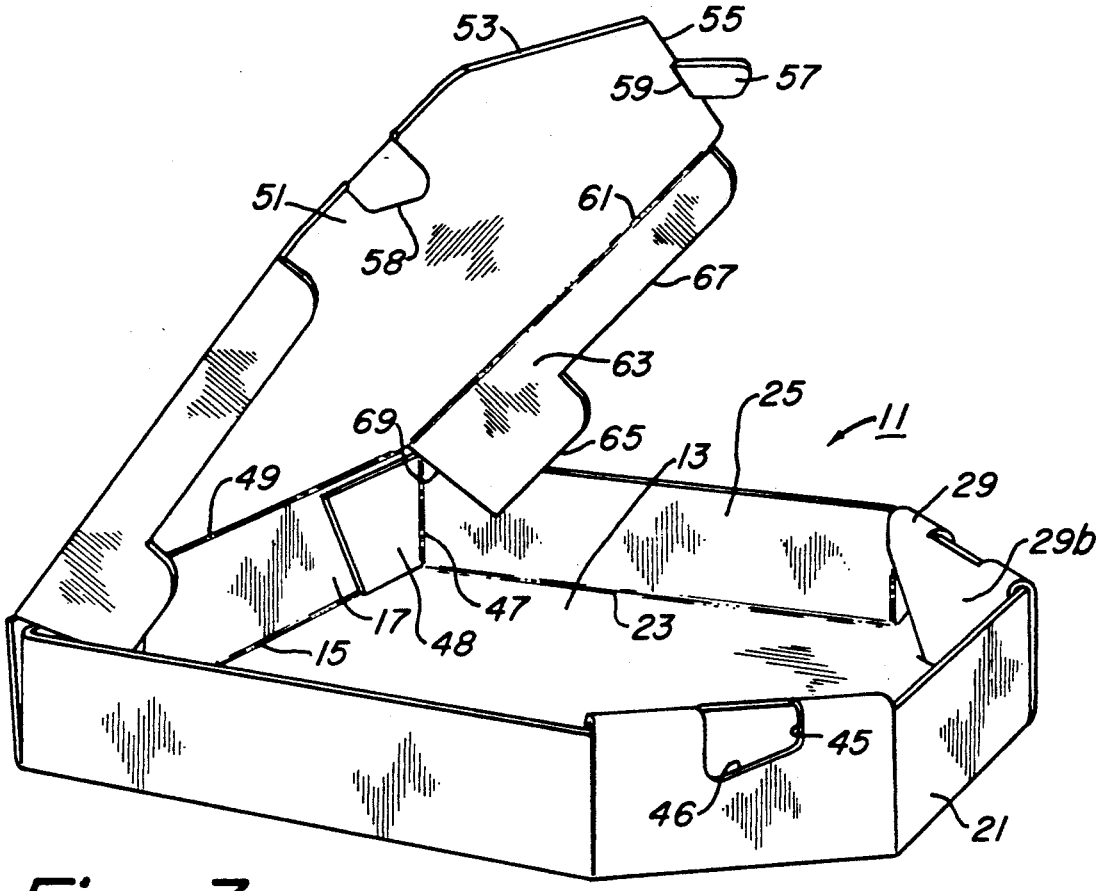
FIG. 3 is another perspective view of the container of FIG. 1, showing the container erected, and in the position for receiving a pizza.

Each corner wall 29 is of double thickness, having an outer ply **29*a* and an inner ply 29*b*. The outer ply 29*a* folds about corner fold line 27. Inner ply 29*b* folds about a pair of corner fold lines 31. Inner ply 29*b* will fold over outer ply 29*a* as illustrated in FIGS. 2 and 3. Outer ply 29*a* is rectangular, while inner ply 29*b* is generally triangular. The edges of inner ply 29*b* are 45 degrees relative to each other, and are truncated at the end by a truncated edge 33. The truncated edge 33 will insert into a slit 35 formed in bottom 13 just inward of corner fold line 27**.

Note that the side edges 36 of outer ply **29*a* extend perpendicular to corner fold line 27 and therefore 45 degrees relative to side fold lines 23. The die cut that forms that side edges 36 separates the inner ply 29*b* from the side walls 25. A side joining fold line 37 extends from the junction of side fold line 23 and corner fold line 27, perpendicular to side fold line 23. This defines a side joining flap 39. Side joining flap 39 will fold over and be sandwiched between the inner and outer plys 29*b*, 29*a*, as illustrated in FIG. 2**.

Similarly, the die cut for the opposite side edge 36 separates outer ply **29*a* from front wall 21. A front joining fold line 41 extends from the junction of front fold line 19 with corner fold line 27. This defines a folding front joining flap 43. Front joining flap 43 also inserts and is sandwiched between the inner and outer plys 29*b*, 29*a* as illustrated in FIG. 2**.

A slot 45 is formed in each outer ply **29*a*. Slot 45 is an aperture that begins at the corner wall fold lines 31 and extends outward. The lower edge 46 is inclined at an acute angle relative to the corner wall fold lines 31. As shown in FIG. 3, when the container 11 is erected, the lower edge 46 will incline relative to bottom 13. Slot 45 will have a greater depth on its outer edge, adjacent side wall 25, than on its inner side, adjacent front wall 21**.

Each side wall 25 has a side rear fold line 47 formed therein, near the intersection with rear fold line 15. Side rear fold line 47 defines a side rear flap 48 which will fold about side rear fold line 47. Side rear flap 48 locates on the inner side of rear wall 17 when erected, as shown in FIG. 3.

Figure 4:
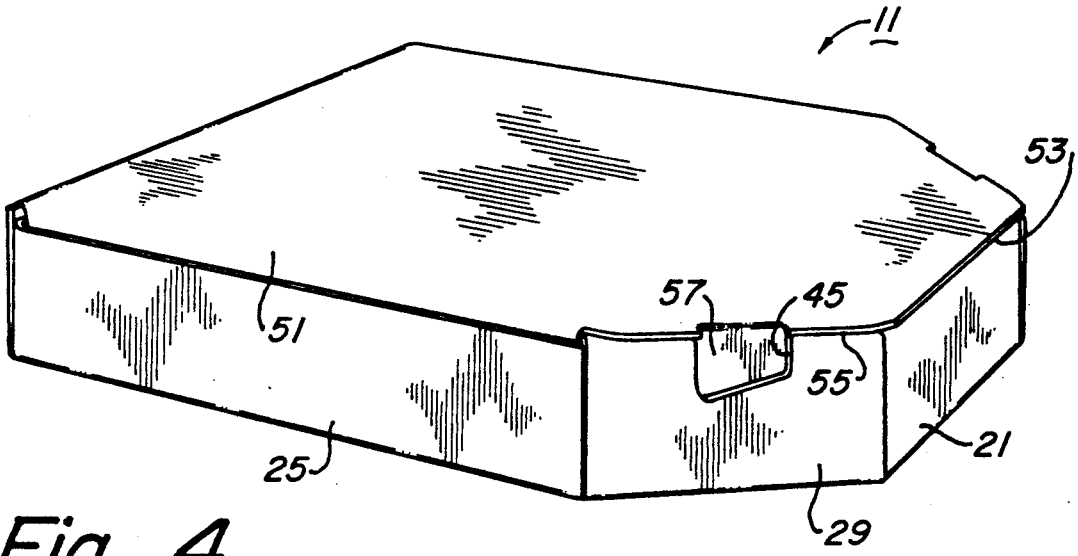
FIG. 4 is another perspective view of the container of FIG. 1, showing the container in a closed position.

A lid fold line 49 locates at the upper edge of rear wall 17, parallel to rear fold line 15. A lid 51 will fold about lid fold line 49 from an open position shown in FIG. 3 to a closed position shown in FIG. 4. Lid 51 has a front edge 53 that will overlie front wall 21 when in the closed position. Lid 51 has a pair of diagonal edges 55 that extend from front edge 53 at a 45 degree angle for overlying corner walls 29.

A tab 57 extends from each lid diagonal edge 55. Tab 57 will fold about a tab fold line 59 for insertion into one of the slots 45. Each tab 57 has a front or lower edge 58 that inclines in reverse to the inclination of slot lower edge 46, as illustrated in FIG. 3. The inclination results in a lesser length for each tab 57 on its outer edge than on its inner edge, near front edge 53. This results in a longer generally pointed portion near front edge 53, which enters the lesser depth part of slot 45. The inclinations of tab edge 58 and slot edge 46 are approximately the same.

A pair of lid side fold lines 61 extend forward from lid fold line 49 to lid diagonal edges 55. A lid flap 63 will fold about each lid side fold line 61 to a position perpendicular to lid 51. Each lid flap 63 has a retaining portion 65 extending from the lid fold line 49 forward to a recessed portion 67. In the embodiment shown, recessed portion 67 extends to the forward edge of lid flap 63, which is at diagonal edge 55.

Retaining portion 65 has a height extending from lid side fold line 61 to its edge that is greater than the height of the recessed portion 67. The height of retaining portion 65 is the same height as the side walls 25. As a result, when in a closed position, the lower edge of each retaining portion 65 will extend down into contact with bottom 13. The height of recessed portion 67 is a little more than one-half the height of retaining portion 65. Consequently, when lid 51 is in the closed position, a clearance will exist between the lower edge of recessed portion 67 and bottom 13. This clearance is sufficient to locate the lower edge of recessed portion 67 over a portion of the perimeter of a typical pizza.

This allows the pizza to extend completely over into contact with side walls 25. The pizza, being circular, will be in its closest position to side wall 25 at a point approximately one-half the distance between rear wall 17 and front wall 21. The length of the retaining portion 65 is less than one-half the length of lid flap 63. Recessed portion 67 will extend through the mid point between rear fold line 15 and front fold line 19. Retaining portion 65 extends only about one-third the distance from lid fold line 49 to lid front edge 53. The rearward edge 69 of each lid flap 63 is inclined at about a 60 degree angle relative to lid fold line 61.

In operation, the user will fold the rear wall 17 upward, the side walls 25 upward, and the front wall 21 upward. The user then folds the corner wall inner ply **29*b* over and inserts the edge 33 into the slits 35. The flaps 39, 43 will be sandwiched between the inner and outer plys 29*b*, 29*a***.

The user folds the lid flaps 63 and folds the lid 51 over to the position shown in FIG. 3. The lid flap retaining portion 65 will locate in frictional contact with the side walls 25. This assists in holding the lid 51 in a partially open position. The user then places the pizza in the container 11 as shown in FIG. 3. The user then closes the lid, while inserting the tabs 57 into the slots 45. Inclined edges 46 and 58 facilitate the entry of the tabs 57, presenting a sharper point for tabs 57 to enter.

The invention has significant advantages. The retaining portions of the flaps retain the lid in a partially open position to assist the user in placing a pizza in an erected box. The diagonal corners save in material over a rectangular container. The diagonal corners allow fast, sturdy erection of the box. The inclined slot for the tabs assist in a quick closure and locking of the container when completed.

While the invention has been shown in only one of its forms, it should be apparent to those skilled in the art that it is not so limited, but is susceptible to various changes without departing from the scope of the invention.

I claim:

1. A container formed of a single piece of paperboard blank for holding a flat circular food product, comprising in combination:

a bottom defined by a rear fold line, a pair of side fold lines, a front fold line, and a pair of corner fold lines, each corner fold line extending diagonally between the front fold line and one of the side fold lines;

a pair of opposed upright side walls extending upward from the bottom at the side fold lines;

a rear wall extending upward from the bottom at the rear fold line;

a front wall extending upward from the bottom at the front fold line;

a lid connected to the rear wall by a lid fold line for moving between an open and a closed position overlying the bottom, the lid having a forward edge and two side edges, the lid having a pair of corner edges, each extending diagonally between the forward edge of the lid and one of the side edges of the lid;

a pair of corner walls, each extending upward from the bottom at one of the corner fold lines;

each of the corner walls being folded over into inner and outer plies and having an upper edge containing a slot, each of the slots extending downward on the outer ply;

a pair of locking tabs, each depending from one of the corner edges of the lid for reception in one of the slots when the lid is in the closed position; and wherein each of the slots has a lower edge that inclines relative to the bottom, the inclined lower edges of the slots facilitating entry of the locking tabs into the slots.

2. A container formed of a single piece of paperboard blank for holding a flat circular food product, comprising in combination:

a bottom defined by a rear fold line, a pair of side fold lines, a front fold line, and a pair of corner fold lines, each corner fold line extending diagonally between the front fold line and one of the side fold lines;

a pair of opposed upright side walls extending upward from the bottom at the side fold lines;

a rear wall extending upward from the bottom at the rear fold line;

a front wall extending upward from the bottom at the front fold line;

a lid connected to the rear wall by a lid fold line for moving between an open and a closed position overlying the bottom, the lid having a forward edge and two side edges, the lid having a pair of corner edges, each extending diagonally between the forward edge of the lid and one of the side edges of the lid;

a pair of corner walls, each extending upward from the bottom at one of the corner fold lines;

each of the corner walls being folded over into inner and outer plies and having an upper edge containing a slot, each of the slots extending downward on the outer ply;

a pair of locking tabs, each depending from one of the corner edges of the lid for reception in one of the slots when the lid is in the closed position; and wherein each of the slots has a lower edge that inclines relative to the bottom, and wherein each of the tabs has an inclined lower edge which inclines in an opposite direction to the lower edge of the slot in which it inserts, the oppositely inclining lower edges of the slots and tabs facilitating entry of the tabs into the slots.

3. A container formed of a single piece of paperboard blank for holding a flat circular food product, comprising in combination:

a bottom;

a pair of opposed upright side walls extending upward from the bottom;

a rear wall extending upward from the bottom on one end of the bottom and joining the side walls;

a front wall extending upward from the bottom on an opposite end of the bottom from the rear wall;

a lid having a rearward edge connected by a fold line to an upper edge of the rear wall for moving between an open and a closed position overlying the bottom;

a pair of lid flaps extending downward from opposite side edges of the lid and locating on an interior side of each of the side walls when the lid is in the closed position, each of the lid flaps having a retaining portion extending from the rearward edge of the lid in a forward direction to a recessed portion, the retaining portion having a height that is greater than the height of the recessed portion to retain the lid in a partially open position to facilitate insertion of the food product, the height of the recessed portion being selected to provide a clearance between the bottom and a lower edge of each of the recessed portions of the lid flaps when the lid is in the closed position, to allow a portion of a perimeter of the food product to extend under the lower edge of each of the recessed portions of the lid flaps into contact with the side walls;

a pair of diagonal corner edges, each intersecting a forward edge of the lid and one of the side edges of the lid; and a pair of diagonal corner walls, each extending upward from the bottom and connecting the front wall and one of the side walls.

4. The container according to claim 3 wherein each of the corner walls is folded over into double ply and has an upper edge containing a slot, the container further comprising:

a pair of locking tabs, each depending from one of the corner edges of the lid for reception in one of the slots when the lid is in the closed position.

5. The container according to claim 4 wherein each of the slots has a lower edge that inclines relative to the bottom, the inclined lower edges of the slots facilitating entry of the locking tabs into the slots.

6. The container according to claim 4 wherein each of the slots has a lower edge that inclines relative to the bottom, and wherein each of the tabs has an inclined lower edge which inclines in an opposite direction to the lower edge of the slot in which it inserts, the oppositely inclining lower edges of the slots and the tabs facilitating entry of the tabs into the slots.

7. The container according to claim 4 wherein each of the corner walls has an inner ply and an outer ply, and wherein the container further comprises:

a pair of slits, each located in the bottom adjacent one of the corner walls for receiving an edge of the inner ply of one of the corner walls to retain each of the corner walls in an upright position.

8. The container according to claim 4 wherein each of the corner walls has an inner ply and an outer ply, and wherein the container further comprises:

a pair of front joining fold lines, each being on the front wall adjacent one of the corner walls, defining a pair of front joining flaps;

a pair of side joining fold lines, each being on one of the side walls adjacent one of the corner walls, defining a pair of side joining flaps; and wherein the inner ply and outer ply of each of the corner walls sandwiches one of the front joining flaps and one of the side joining flaps to join each of the corner walls to one of the side walls and to the front wall.

9. A container formed of a single piece of paperboard blank for holding a flat circular food product, comprising in combination:

a bottom defined by a rear fold line, a pair of side fold lines, a front fold line, and a pair of diagonal corner fold lines, each extending between the front fold line and one of the side fold lines;

a pair of opposed upright side walls extending upward from the bottom at the side fold lines;

a rear wall extending upward from the bottom at the rear fold line;

a front wall extending upward from the bottom at the front fold line;

a lid connected to the rear wall by a lid fold line for moving between an open and a closed position overlying the bottom, the lid having a pair of side edges and a forward edge, the lid having a pair of corner edges, each extending diagonally between the forward edge of the lid and one of the side edges of the lid;

a pair of diagonal corner walls, each extending upward from the bottom at one of the diagonal fold lines;

each of the corner walls being folded over into inner and outer plies;

a pair of slits, each located in the bottom adjacent one of the corner fold lines for receiving an edge of the inner ply of one of the corner walls to retain each of the corner walls in an upright position;

a pair of front joining fold lines, each on the front wall adjacent one of the corner walls, defining a pair of front joining flaps;

a pair of side joining fold lines, each on one of the side walls adjacent one of the corner walls, defining a pair of side joining flaps;

the inner ply and outer ply of each of the corner walls sandwiching one of the front joining flaps and one of the side joining flaps to join each of the corner walls to one of the side walls and to the front wall;

each of the corner walls having an upper edge containing a slot, each of the slots extending downward on the outer ply, terminating in a lower edge that inclines relative to the bottom; and a pair of locking tabs, each depending from one of the corner edges of the lid for reception in one of the slots when the lid is in the closed position, each of the locking tabs having an inclined lower edge that inclines in an opposite direction from the inclined lower edge of the slot in which it locates, the inclined lower edges of the tabs and slots facilitating entry of the locking tabs into the slots.

* * * * *